US005893182A

United States Patent [19]

Sutherland et al.

[11] Patent Number: 5,893,182

[45] Date of Patent: Apr. 13, 1999

[54] COMBINATION ITEM OF FURNITURE AND FOLDABLE SLEEPER BED

[75] Inventors: Mark Sutherland; Peter Weisz, both of Richmond Hill, Canada

[73] Assignee: L&P Property Management Company, South Gate, Calif.

[21] Appl. No.: 08/862,675

[22] Filed: May 23, 1997

[51] Int. Cl.[6] ..... A47C 17/22

[52] U.S. Cl. ..... 5/13; 5/12.1; 5/14; 297/63; 297/105

[58] Field of Search ..... 5/13, 12.1, 14, 5/17, 25; 297/63, 105, 62, 125, 112

[56] References Cited

U.S. PATENT DOCUMENTS

| | | | |
|---|---|---|---|
| 1,085,911 | 2/1914 | Honsinger | 5/14 |
| 1,158,240 | 10/1915 | Kroehler . | |
| 1,274,431 | 8/1918 | Miesner . | |
| 1,408,014 | 2/1922 | Luppino | 5/14 |
| 1,951,805 | 3/1934 | Palmieri | 5/14 |
| 2,605,480 | 8/1952 | Miesner . | |
| 2,673,355 | 3/1954 | Ducrot | 5/14 |
| 2,911,655 | 11/1959 | Pokorny | 5/14 |
| 4,800,598 | 1/1989 | Arft . | |
| 4,850,065 | 7/1989 | Swiderski et al. . | |
| 4,985,945 | 1/1991 | Robinson . | |
| 5,305,479 | 4/1994 | Robinson . | |
| 5,503,086 | 4/1996 | Hoffman et al. . | |

FOREIGN PATENT DOCUMENTS 2127683 of 1980 United Kingdom .

*Primary Examiner*—Michael F. Trettel
*Assistant Examiner*—Fredrick Conley
*Attorney, Agent, or Firm*—Wood, Herron & Evans, L.L.P.

[57] ABSTRACT

A combination ottoman, table or desk and a foldable sleeper bed comprises upper and lower wooden frame sections, the lower frame section being configured as an open top box, atop which the upper frame section is located. The two frame sections are interconnected by a pair of opposed four-bar linkages which permit the upper frame section to be moved between a first position in which it rests atop and encloses the lower frame section, and a second raised position in which it is spaced upwardly and rearwardly from the lower frame section. Contained within the enclosure defined by the upper and lower frame sections, there is a foldable sleeper bed having pivotally interconnected head, body, intermediate and foot sections, which sections are extendable forwardly from the lower frame section when the upper frame section is in the second raised position to form a bed and foldable to fit and be contained within the enclosure when the bed is collapsed and stored.

14 Claims, 2 Drawing Sheets

COMBINATION ITEM OF FURNITURE AND FOLDABLE SLEEPER BED

This invention relates to an item of furniture which may be used alternatively as one of an ottoman, a table or a desk and which includes a foldable bed collapsed and stored within the interior of the item of furniture.

BACKGROUND OF THE INVENTION

Foldable sofa sleepers having a pivotally interconnected head, body, intermediate and foot sections movable between a fully folded or retracted position within a chair or sofa frame and an extended unfolded position for use as a bed are well known in the art as exemplified, for example, by U.S. Pat. No. 5,305,479. Generally, such sofa sleepers contain cushions which cover and hide the folded bed when the chair or sofa is used as a seating surface. And when the bed is unfolded, those cushions are simply removed and placed to the side. But, such sofa sleepers or combination chairs and foldable beds are relatively large items of furniture which are not suitable for use in small apartments, trailers or locations of very limited space. It has therefore been an objective of this invention to provide a foldable bed which may be combined with an item of furniture, which item of furniture has a much smaller footprint or smaller surface area than conventional sofa sleepers or chair/sleeper combinations, but which may still hide and contain a foldable sleeper bed.

Still another object of this invention has been to provide a foldable sleeper bed which may be contained within a completely enclosed item of furniture, such as an enclosed coffee table, ottoman or desk and which, when unfolded, does not require the removal of cushions or other portions of the item of furniture to enable the bed to be unfolded and used as a sleeping surface.

SUMMARY OF THE INVENTION

The item of furniture of this invention which accomplishes these objectives comprises a combination ottoman, table or desk and a foldable sleeper bed contained within that item of furniture. That item of furniture as, for example, an ottoman, comprises upper and lower frame sections, the lower frame section being configured as an open top box, atop which there is an upper frame section, the two frame sections being interconnected by a pair of opposed four-bar linkages which permit the upper frame section to be moved between a first position in which it rests atop and encloses the lower frame section, and a second raised position in which it is spaced upwardly and rearwardly from the lower frame section. Contained within the enclosure defined by the upper and lower frame sections, there is a foldable sleeper bed having pivotally interconnected head, body, intermediate and foot sections, which sections are extendable forwardly from the lower frame section when the upper frame section is in the second raised position to form a bed and foldable to fit and be contained within the enclosure when the bed is collapsed and stored. The furniture frame, when the bed is folded and contained within the enclosure defined by the frame, is usable as a furniture ottoman, in which case the exterior of the frame is generally upholstered, or it is usable as a table, such as a coffee table, if the top surface of the upper frame section is left flat and unupholstered. The item of furniture is also usable as a desk as well as an ottoman when the upper frame section is in its second or raised position because it is at a convenient height for use as a writing surface or to support a desktop computer, etc., so long as the top surface of the ottoman is flat and configured as a tabletop.

The primary advantage of the combination item of furniture described hereinabove is the minimal space which it occupies while still providing a stored bed usable as a comfortable sleeping surface.

These and other objects and advantages of this invention will be more readily apparent from the following description of the drawings.

Figure 1:
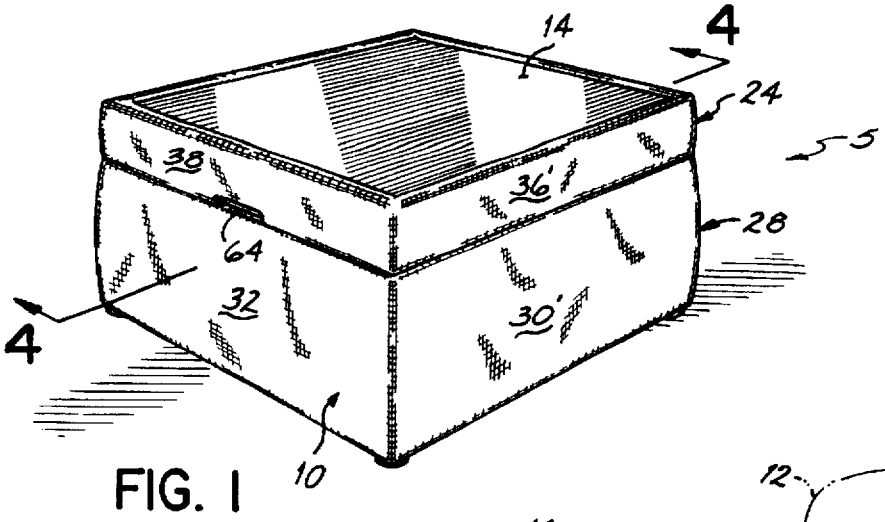
FIG. 1 is a perspective view of an item of furniture as, for example, an ottoman or coffee table incorporating the invention of this application.

The combination item of furniture 5 of this invention comprises a wooden box-like enclosure or frame 10 within which there is contained a foldable sleeper bed 20. The box-like-shaped item of furniture 5 may be utilized as any one of numerous different items of furniture as, for example, an ottoman, when appropriately upholstered (as illustrated in the drawings) and used in combination with a chair 12, or as a table, such as a coffee table when provided with a flat top surface 14. But irrespective of how the item of furniture 5 is utilized, it contains a foldable sleeper bed 20 which may be unfolded from the interior of the item of furniture 5 and used as a comfortable sleeping surface. To facilitate these multiple uses, the invention of this application comprises the wooden furniture frame 10 having an upper movable section 24 connected through appropriate linkage 26 to a stationary lower wooden frame section 28. The lower frame section comprises a base 29 from which there are two upstanding side walls 30, as well as a front wall 32 and rear wall 34. The four walls 30, 30', 32, 34 generally define an open top box within which the foldable bed 20 is mounted. To this open top box-shaped lower frame, there is mounted by the linkage 26, the upper frame section 24, which upper frame section comprises two opposed side walls 36, 36', a front wall 38, and a rear wall 40 interconnected by a top or top wall 42. The lower frame section 28 is generally configured as an open-top box and the upper frame section 24 is an open-bottom box, the side walls of the two sections being co-extensive when the furniture frame 10 is closed with the bed 20 folded and residing on the interior of the lower frame section 28.

Figure 2:
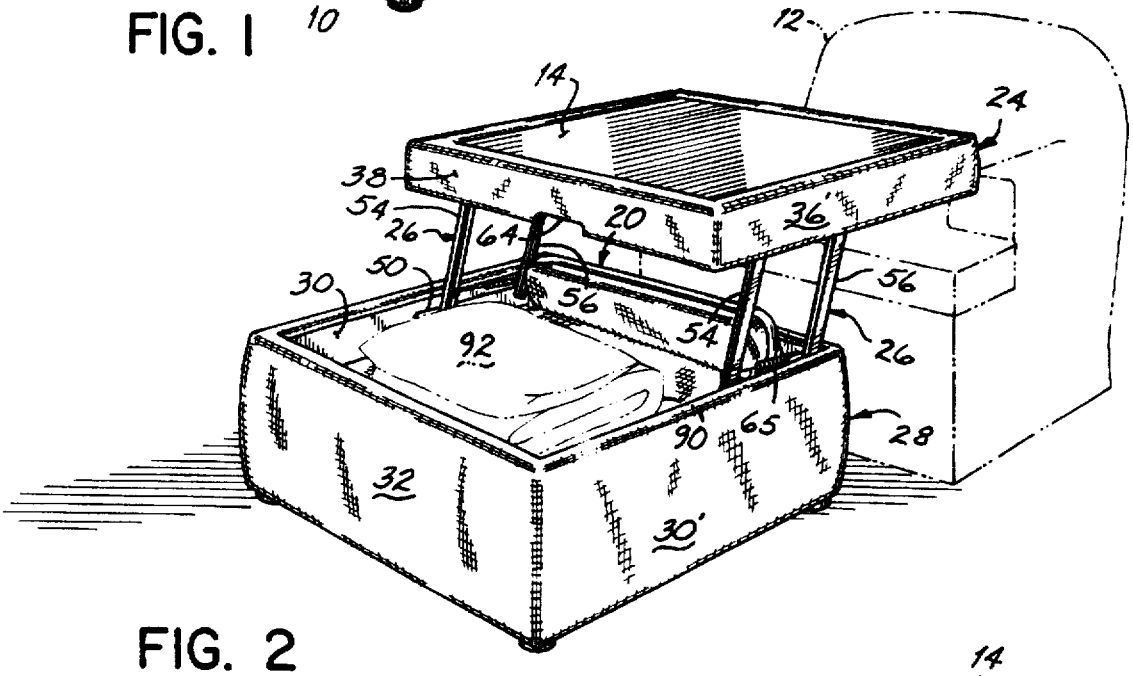
FIG. 2 is a perspective view of the item of furniture illustrated in FIG. 1, but with the top section of the frame of the item of furniture in a raised or elevated position preparatory to removal of a foldable bed from the interior of the furniture frame.

The linkage 26 which interconnects the two frame sections comprises a pair of opposed four-bar linkages 26, 26' mounted upon the opposite side walls 36, 36' of the lower and upper frame sections. Each of these four-bar linkages comprises a lower bar 50 fixedly attached to one of the side walls 30 of the lower frame section 28, and an upper bar 52 fixedly attached to the corresponding side wall 36 of the upper frame section 24. These bars 50, 52 are in turn each pivotally connected to a pair of spaced parallel connecting bars 54, 56, the connection being such that the upper frame section 24 may be lifted and pivoted from a first lower position in which it rests atop the lower frame section 28 to a second raised or elevated position in which it resides in a position spaced upwardly and rearwardly from the lower frame section, as best illustrated in FIG. 2. The upper frame section 24 is maintained in this elevated position by the four-bar linkage going over vertical center to a position in which a rear edge 58 of at least one of the connecting bars 56 rests against an adjustable stop 60 of the lower bar 50. This stop 60 comprises a bolt threaded into a vertically upstanding portion 62 of the lower bar 50. To facilitate lifting and raising of the upper frame section relative to the lower frame section, there is preferably a hand hold 64 formed in the front wall 38 of the upper frame section 24. A similar hand hold may be formed in the rear wall 40.

To increase the force holding the upper frame section 24 in the raised or elevated position illustrated in FIG. 2 and to assist in moving it to that position from its lower position, there is a tension spring 65 which extends between the lower end of the forwardmost connecting link 54 and the vertically upstanding portion 62 of the lower bar 50. As the upper frame section 24 is lowered from the raised position illustrated in FIG. 2 to the closed or lower position illustrated in FIGS. 1 and 4, the spring 64 is stretched. Consequently, its spring force is available to and does assist in raising the upper frame section 24 and in holding it in its most elevated position in which the rear connecting bar 56 rests against the stop 60.

The foldable sleeper bed 20 has a frame which comprises a head section 72, a body section 74 pivotally connected at one end to the head section 72, a short intermediate section 76 pivotally connected at one end to the other end of the body section 74, and a foot section 78 pivotally connected to the other end of the intermediate section 76. The head section 72 and foot section 78 each comprises similar symmetrically disposed left and right opposed side rails interconnected by an end rail. The body section 74, the intermediate section 76, and the foot section 78 each comprise similar symmetrically disposed left and right side rails which may be interconnected by cross members (not shown).

The interconnected bed frame sections 72, 74, 76 and 78 are supported in their extended position by a pair of foldable generally U-shaped support legs 80, 82 pivotally connected at their upper ends to the foot section side rails and body section rails, respectively. A continuous section of wire link material or a sheet of woven or unwoven fabric material is connected to and extends between the side rails of the interconnected bed frame section 72, 74, 76 and 78 so as to provide a supporting surface for a foldable mattress 84.

Figure 3:
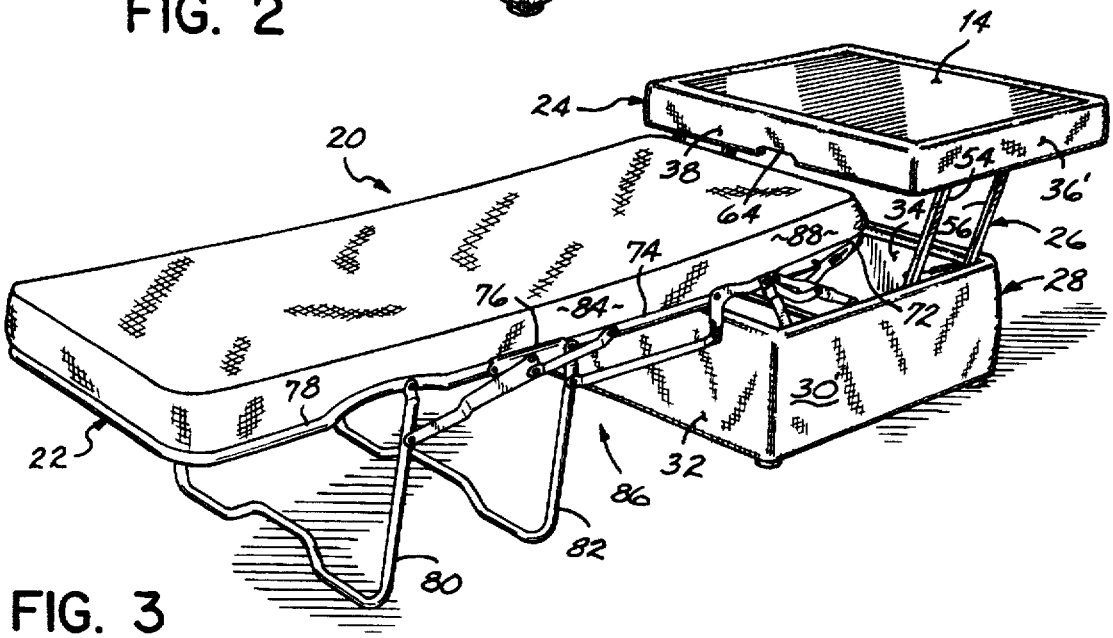
FIG. 3 is a perspective view of the item of furniture of FIG. 2, but with the foldable bed unfolded from the interior of the furniture frame.

In order to support the sleeper bed frame 22 for controlled collapsing movement into the wooden lower frame section 28, there is a linkage system, generally designated by the numeral 86, which extends between and interconnects the side walls 30, 30' of the wooden lower frame section 28 and the foldable sleeper bed frame 22. This linkage system per se forms no part of the invention of this application, and therefore has not been described in detail herein. A complete description of one such linkage system suitable for use in the practice of this invention is completely described in the assignee's own U.S. Pat. No. 4,253,202, the disclosure of which is incorporated by reference herein. Other patents assigned to the assignee which disclose foldable sleeper bed linkage systems equally capable of use in connection with a foldable bed frame for connecting the foldable bed frame to the side walls 30, 30' of the lower frame section 28 are disclosed in U.S. Pat. Nos. 4,850,065; 4,985,945; 4,800,598; and, 5,305,479. These linkage systems not only control the folding of the foldable sleeper bed frame 22 and legs 80, 82 into the storage enclosure of the lower frame section 28, but also control the unfolding of that frame 22 and supporting legs when the foldable bed frame is translated from the stored position illustrated in FIG. 4 to the unfolded position illustrated in FIG. 3. In the stored position of the sleeper bed 20, it will be noted that the head section 72 and intermediate section 76 of the bed frame 22 are located in a vertical plane, while the body and leg sections 74, 78, respectively, are located in a horizontal position with the mattress 84 folded double between the horizontally extending body support section 74 and foot support section 78, and the head end section 88 of the mattress folded into a vertical attitude parallel to the upstanding head section 72 of the bed frame 22.

Figure 4:
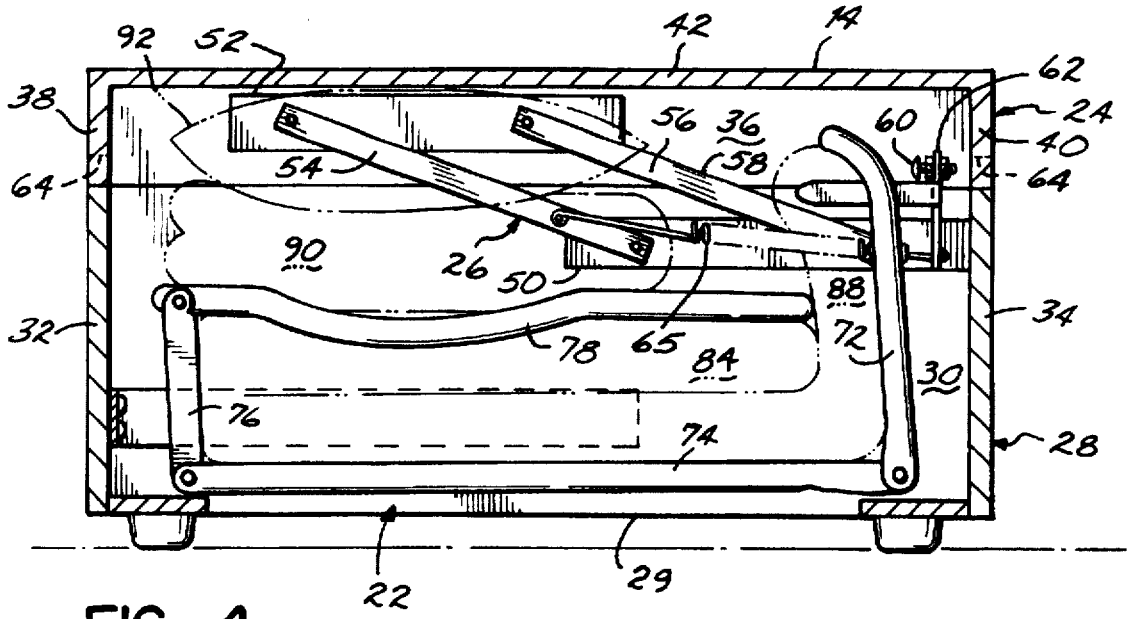
FIG. 4 is a cross sectional view taken on line 4—4 of FIG. 1.

With reference to FIG. 4, it will be noted that there is depicted in phantom in this figure a blanket 90 and pillow 92 resting atop the folded mattress 84. The height of a conventional folded sleeper bed frame, approximately 11 inches, is substantially less than the height, approximately 18 inches, of a standard seating surface or ottoman associated with that seating surface. Consequently, an enclosure formed by the upper and lower frame sections 24, 28, respectively, formed in accordance with the practice of this invention, leaves approximately 7 vertical inches of space on the interior of the enclosure for the storage of pillows, bedding and similar items atop the folded bed frame 22 and mattress 84.

In the use of the item of furniture 5 described hereinabove, whether that item of furniture is used as a table, such as a coffee table, with a flat top surface 14 having a foldable bed contained on the interior thereof, or as an ottoman with parallel and upholstered front, rear and side walls, and possibly a padded and upholstered top wall 42, the item of furniture is usually maintained with the top frame section in its lower or folded position illustrated in FIGS. 1 and 4. When the item of furniture 5 is to be used as a bed, the top frame section 24 is lifted upwardly to the position illustrated in FIG. 2 whereat the rear connecting bar 56 of the linkage 26 engages the stop 60 to hold the opposed four-bar linkages in a raised over center position. In this position, the top surface 14 of the upper frame section 24 is located in an ideal elevation for use as a desktop writing surface or a portable computer support surface elevated approximately 8 inches above a normal seating surface height of 18 inches. If the top surface 14 of the ottoman is to be used as a desk surface in the manner illustrated in FIG. 2, then the foldable bed 20 is maintained in a closed or folded position as illustrated in FIGS. 2 and 4, while the top section 24 is maintained in a raised position. But if the foldable bed is to be used for sleeping, then the foldable bed frame 22 is lifted upwardly and outwardly over the front wall 32 of the lower frame section 28 so as to position the mattress 84 in a horizontal attitude preparatory to use as a horizontal sleeping surface.

To return the mattress and foldable bed frame to the stored position, the front of the foot section 78 of the bed frame is lifted in the conventional manner so as to fold the legs 80, 82 of the bed to a position substantially parallel to the foot section 78 of the foldable frame 22 and the frame lowered into the enclosure of the lower frame section 28. In so positioning the foldable bed frame, the head section 72 of the frame moves into a vertical attitude as does the intermediate section 76 with the folded mattress located between the horizontally extending body section 74 and leg section 78 of the folded frame. The upper frame section 24 is then moved downwardly from its elevated position illustrated in FIG. 2 to the closed position illustrated in FIGS. 1 and 4 to convert the item of furniture 5 from a bed to an ottoman or coffee table, as the case may be.

While we have described only a single preferred embodiment of our invention, persons skilled in the art to which this invention pertains will appreciate changes and modifications which may be made without departing from the spirit of our invention. Therefore, we do not intend to be limited except by the scope of the following appended claims.

We claim:

1. A combination item of furniture and foldable sleeper bed, said item of furniture being usable as at least one of an ottoman, a table or a desk, said item of furniture having a furniture frame comprising a lower furniture frame section and an upper furniture frame section, said lower furniture frame section comprising a base and frame side walls extending upwardly from said base, said upper furniture frame section being located atop the lower furniture frame section and including a substantially planar top horizontal surface;

a furniture linkage extending between and connecting the lower furniture frame section to the upper furniture frame section, said furniture linkage enabling said upper furniture frame section to be movable between a first position in which said upper furniture frame section rests atop and encloses the top of said lower furniture frame section with the top surface located in a horizontal plane and a second position in which said upper furniture frame section is maintained and fixedly supported in a position spaced upwardly and rearwardly from said lower furniture frame section with the top surface located in a horizontal plane; and a foldable sleeper bed assembly mounted upon said lower furniture frame section, said bed assembly being extendable forwardly from said lower furniture frame section to form a bed and foldable to fit and be contained within an enclosure defined by said furniture frame wherein said upper furniture frame section has four side walls and said furniture linkage extends between and is secured to said side walls of said upper and lower furniture frame sections.

2. The combination of claim 1 wherein said foldable sleeper bed assembly comprises pivotally interconnected head, body, intermediate and foot sections.

3. The combination of claim 2 wherein said head and intermediate sections of said sleeper bed assembly are located in a vertical plane and said body and intermediate sections are located in a horizontal plane when said sections are folded and contained with said furniture linkage.

4. The combination of claim 1 wherein said furniture linkage includes spring means for assisting movement of said upper furniture frame section between said first and second positions, said spring means further being operable to assist in holding said upper furniture frame section in said second position.

5. The combination of claim 1 wherein said furniture linkage comprises a pair of opposed four bar linkages.

6. The combination of claim 1 wherein said furniture linkage comprises a pair of opposed four bar linkages, each of said four bar linkages having a lower bar fixedly secured to said lower furniture frame section, an upper bar fixedly secured to said upper furniture frame section, and a pair of spaced parallel connector bars pivotally extending between and connecting said upper and lower bars.

7. The combination of claim 5 wherein said furniture linkage includes a stop element attached to said lower bar for engaging one of said connector bars when said upper furniture frame section is in said second position.

8. A combination item of furniture and foldable sleeper bed comprising a lower furniture frame section having a base and side walls extending upwardly from said base and an upper furniture frame section comprising side walls extending downwardly from a top horizontal surface, said upper furniture frame section being located atop the lower furniture frame section, a furniture linkage comprising two pairs of parallel connecting bars extending between and connecting the lower furniture frame section to the upper furniture frame section, said furniture linkage enabling said upper furniture frame section to be movable between a first position in which said upper furniture frame section rests atop and encloses the top of said lower furniture frame section and a second position in which said upper furniture frame section is spaced upwardly and rearwardly from said lower furniture frame section; and a foldable sleeper bed assembly mounted upon said lower furniture frame section, said bed assembly having pivotally interconnected body, intermediate and foot sections, each including a pair of opposed side rails, said bed assembly sections being extendable forwardly from said lower furniture frame section to form a bed and foldable to fit and be contained within an enclosure defined by said furniture frame wherein said connecting bars are part of a pair of opposed four-bar linkages mounted on the side walls of the upper and lower furniture frame sections.

9. The combination item of furniture and foldable sleeper bed of claim 8 wherein said four-bar linkages are mounted inside the side walls of the lower and upper furniture frame sections.

10. A combination convertible enclosure and foldable sleeper bed, said enclosure being configured as an item of furniture such as an ottoman, coffee table or desk, said combination comprising:

a stationary enclosure frame comprising a lower enclosure frame section and an upper enclosure frame section, said lower enclosure frame section comprising a base and frame side walls extending upwardly from said base, said upper enclosure frame section having a substantially planar top surface and frame side walls and being located atop the lower enclosure frame section;

an enclosure linkage comprising two pairs of parallel connecting bars extending between and connecting the lower enclosure frame section to the upper enclosure frame section, said enclosure linkage enabling said upper enclosure frame section to be movable between a first position in which said upper enclosure frame section rests atop and encloses the top of said lower enclosure frame section, and a second position in which said upper enclosure frame section is spaced upwardly and rearwardly from said lower enclosure frame section; and a foldable sleeper bed assembly mounted upon said lower enclosure frame section, said bed assembly having pivotally interconnected body, intermediate and foot sections, each including a pair of opposed side rails, said bed assembly sections being extendable forwardly from said lower enclosure frame section to form a bed and foldable to fit and be contained within said enclosure frame wherein said connecting bars are part of a pair of four-bar linkages mounted to said frame side walls of the lower and upper enclosure frame sections.

11. A combination convertible ottoman and foldable sleeper bed comprising:

a stationary ottoman frame comprising a lower ottoman frame section and an upper ottoman frame section, each of said upper and lower ottoman frame sections comprising four side walls, said upper ottoman frame section being located atop the lower ottoman frame section;

an ottoman linkage comprising a pair of opposed four-bar linkages mounted on said side walls of said upper and lower ottoman frame sections and extending between and connecting the lower ottoman frame section to the upper ottoman frame section, said ottoman linkage enabling said upper ottoman frame section to be movable between a first position in which said upper ottoman frame section rests atop and encloses the top of said lower ottoman frame section, and a second position in which said upper ottoman frame section is spaced upwardly and rearwardly from said lower ottoman frame section; and a foldable sleeper bed assembly mounted upon said lower ottoman frame section.

12. The combination convertible ottoman and foldable sleeper bed of claim 11 wherein each of said four-bar linkages comprises a lower bar fixedly attached to one of the side walls of the lower ottoman frame section, an upper bar fixedly attached to one of the side walls of the upper ottoman frame section and a pair of parallel connecting bars.

13. The combination convertible ottoman and foldable sleeper bed of claim 11 wherein said bed assembly has pivotally interconnected body, intermediate and foot sections, each including a pair of opposed side rails, said bed assembly sections being extendable to form a bed and foldable to fit and be contained within said ottoman frame.

14. The combination convertible ottoman and foldable sleeper bed of claim 12 wherein said ottoman linkage includes a stop element attached to said lower bar to at least one of said four-bar linkages for engaging one of said connecting bars when said upper ottoman frame section is in said second position.

* * * * *